US008568192B2

(12) United States Patent
Raichman et al.

(10) Patent No.: US 8,568,192 B2
(45) Date of Patent: Oct. 29, 2013

(54) METHOD AND SYSTEM OF MANAGING A GAME SESSION

(75) Inventors: Yossef Raichman, Herzlia (IL); Moshe Cohen, Tel-Aviv (IL); Eliran Aronov, Ramla (IL)

(73) Assignee: In-Dot Ltd., Tel-Aviv (IL)

( * ) Notice: Subject to any disclaimer, the term of this patent is extended or adjusted under 35 U.S.C. 154(b) by 49 days.

(21) Appl. No.: 13/308,594

(22) Filed: Dec. 1, 2011

(65) Prior Publication Data

US 2013/0143468 A1 Jun. 6, 2013

(51) Int. Cl.
*A63H 13/00* (2006.01)

(52) U.S. Cl.
USPC ..... 446/268; 463/1; 463/42; 446/175; 446/484

(58) Field of Classification Search
USPC ..... 463/1, 42; 446/175, 268, 484
See application file for complete search history.

(56) References Cited

U.S. PATENT DOCUMENTS

| | | | | |
|---|---|---|---|---|
| 5,752,880 | A * | 5/1998 | Gabai et al. | 463/1 |
| 6,089,942 | A * | 7/2000 | Chan | 446/175 |
| 6,110,000 | A * | 8/2000 | Ting | 446/302 |
| 6,309,275 | B1 * | 10/2001 | Fong et al. | 446/297 |
| 6,352,478 | B1 * | 3/2002 | Gabai et al. | 463/42 |
| 6,358,111 | B1 * | 3/2002 | Fong et al. | 446/297 |
| 6,551,165 | B2 * | 4/2003 | Smirnov | 446/175 |
| 6,631,351 | B1 * | 10/2003 | Ramachandran et al. | 704/270 |
| 6,648,719 | B2 * | 11/2003 | Chan | 446/297 |
| 6,682,387 | B2 * | 1/2004 | Choi | 446/175 |
| 6,682,392 | B2 * | 1/2004 | Chan | 446/335 |
| 6,729,934 | B1 * | 5/2004 | Driscoll et al. | 446/297 |
| 7,252,572 | B2 * | 8/2007 | Wright et al. | 446/484 |
| 7,297,044 | B2 * | 11/2007 | Small et al. | 446/454 |
| 7,568,963 | B1 * | 8/2009 | Atsmon et al. | 446/175 |
| 7,878,905 | B2 * | 2/2011 | Weston et al. | 463/39 |
| 2003/0064812 | A1 * | 4/2003 | Rappaport et al. | 463/43 |
| 2010/0311507 | A1 * | 12/2010 | Raichman et al. | 463/42 |
| 2011/0009175 | A1 * | 1/2011 | Raichman et al. | 463/1 |
| 2011/0027770 | A1 * | 2/2011 | Cohen et al. | 434/362 |

FOREIGN PATENT DOCUMENTS

| | | | |
|---|---|---|---|
| GB | 2355891 | A * | 5/2001 |

* cited by examiner

*Primary Examiner* — Dmitry Suhol
*Assistant Examiner* — David Duffy

(57) ABSTRACT

A learning plaything set to communicate with similar learning playthings during a game session. The learning plaything comprises a reader which reads a plurality of data marks indicative of a plurality of playing abilities, a memory for storing the plurality of playing abilities, a communication unit which establishes at least one wireless connection with another communication unit of at least one other learning plaything during a game session, a management module which uses the at least one wireless connection to coordinate an outcome to the game session with the at least one other learning plaything according to the stored plurality of playing abilities, and at least one presentation unit which presents at least one plaything action according to the outcome.

21 Claims, 7 Drawing Sheets

METHOD AND SYSTEM OF MANAGING A GAME SESSION

FIELD AND BACKGROUND OF THE INVENTION

The present invention, in some embodiments thereof, relates to communicating playthings and, more particularly, but not exclusively, to method and system of performing a game session among playthings.

Collectible playthings, such as figurines, cards, and tossing elements, such as Gogo's Crazy Bones™, and Bakugan Battle Brawlers™, have been hot commodity for children during the last decades.

A number of developments have been made to provide children with communicating collectables. For example U.S. Pat. No. 7,252,572, filed on May 12, 2004, describes a method for figurines to form and join a network of figurines by setting them near other figurines, by activating them via a power switch, or by placing them in communication with a central hub. A communications path using radio or IR frequency is used to form the network; such that only one figurine can transmit data while the others receive data at any time. Once the network has been formed, the figurines can formulate behaviors based on the attributes, requests, and actions of the others. These behaviors are based on the data transpired between the figurines and can include meaning of spoken words, current state, etc. Each figurine has a personality controlled by its internal data, which also controls its relationships with others. Each figurine can spontaneously create a speech or action based on the reply given by another coupled with data stored within its databank.

SUMMARY OF THE INVENTION

According to some embodiments of the present invention, there is provided a learning plaything which is set to communicate with similar learning playthings during a game session. The learning plaything comprises a reader which reads a plurality of data marks indicative of a plurality of playing abilities, a memory for storing the plurality of playing abilities, a communication unit which establishes at least one wireless connection with another communication unit of at least one other learning plaything during a game session, a management module which uses the at least one wireless connection to coordinate an outcome to the game session with the at least one other learning plaything according to the stored plurality of playing abilities, and at least one presentation unit which presents at least one plaything action according to the outcome.

Optionally, the learning plaything comprises a timer which monitors the reading time of the plurality of playing abilities; wherein the management module adjusts the plurality of playing abilities according to the reading time.

Optionally, the management module updates the plurality of playing abilities according to the at least one action.

Optionally, the communication unit embeds a message to the another communication unit in a theme music played during the game session.

Optionally, the at least one action is indicative of a group of at least one of the plurality of playing abilities to transfer to the at least one other learning plaything, the communication unit sends a message indicative of the group to the at least one other learning plaything.

Optionally, the learning plaything comprises a movement sensor for detecting a movement of the learning plaything or at least one object in relation thereto; wherein the management module calculates the at least one action according to the movement.

Optionally, the learning plaything comprises a proximity sensor for detecting a proximity of the at least one other learning plaything; wherein the management module calculates the at least one action according to the proximity.

Optionally, the learning plaything comprises a contact sensor for detecting a contact between the at least one other learning plaything and the learning plaything; wherein the management module calculates the at least one action according to the contact.

Optionally, the reader has a card slot for hosting at least one of a plurality of cards marked with the plurality of marks and an ejection mechanism for ejecting the at least one card; wherein the at least one action comprises instructing the ejection mechanism to eject the at least one card.

More optionally, the ejection mechanism performs the ejecting with a power defined by the at least one card.

Optionally, the at least one presentation unit comprises a screen for displaying the plurality of stored playing abilities.

Optionally, the management module calculates the at least one plaything action according to a random value generated by a random generator.

Optionally, the management module calculates the at least one plaything action according to a match between the plurality of playing abilities and a plurality of other playing abilities of the at least one other learning plaything.

According to some embodiments of the present invention, there is provided an interactive system for providing entertainment to a plurality of participants. The interactive system comprises a plurality of learning playthings which are set to communicate with one another during a game session, each the learning plaything having: a reader which reads a plurality of marks indicative of a plurality of playing abilities, a memory for storing the plurality of playing abilities, a communication unit which establishes a wireless connection with another communication unit of at least one other learning plaything during a game session, a management module which uses the wireless connection to coordinate at least one plaything action with the at least one other learning plaything according to the stored plurality of playing abilities, and at least one presentation unit which presents the plaything action.

According to some embodiments of the present invention, there is provided a method of managing an interactive game among a plurality of participants. The method comprises loading a plurality of different playing abilities into a plurality of different learning playthings by allowing each different learning plaything to read at least one mark indicative of at least one of the plurality of different playing abilities, establishing at least one wireless connection between the plurality of learning playthings to transfer information about the plurality of loaded different playing abilities from at least one of the plurality of learning playthings to another, calculating, during a game session between the plurality of learning playthings, an outcome to the game session according to the plurality of different playing abilities, and instructing at least one of the plurality of different learning playthings to present at least plaything action according to the outcome.

Optionally, the at least one wireless connection is a peer to peer connection.

Optionally, the at least one wireless connection is established via a proxy.

Optionally, the loading is performed in a certain order, the calculating being performed according to the certain order.

Optionally, the calculating is based on a random variable.

Optionally, the method further comprises detecting a proximity to a reference object; the calculating is based on the proximity.

Optionally, the method further comprises detecting a movement of at least one of the different learning playthings during the game session; the calculating is based on the movement.

Optionally, the method further comprises detecting a presence or absence of a contact to an object; the calculating is based on the detecting.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As to software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, non-transitory computer readable media such as, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1:
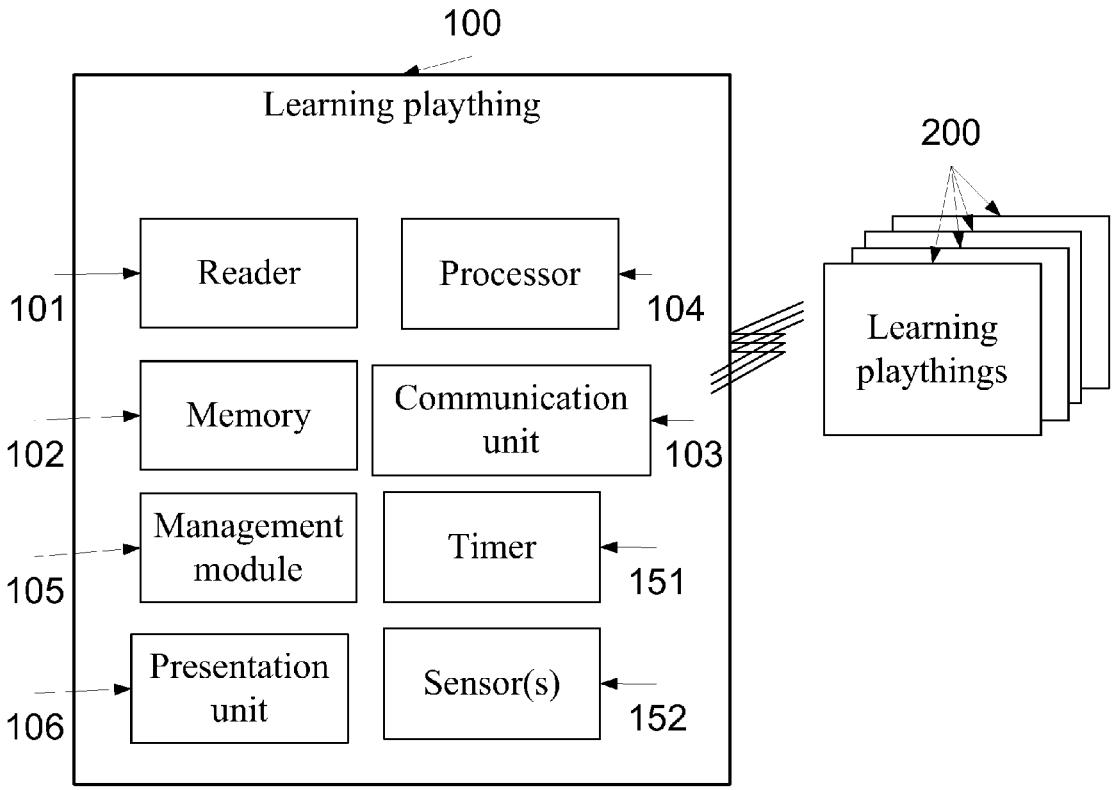
FIG. 1 is a schematic illustration of a learning plaything that is set to be loaded with a number of playing abilities which may be transferred to another learning plaything according to outcomes of a game session, according to some embodiments of the present invention.

The present invention, in some embodiments thereof, relates to communicating playthings and, more particularly, but not exclusively, to methods and systems of performing a game session among the playthings.

According to some embodiments of the present invention, there is provided a learning plaything, optionally having a housing shaped as an action figure, a vehicle, a humanoid figure, and/or an animal, which is set to be dynamically loaded with one or more playing abilities and to coordinate an outcome of a game session, such as a contest and/or battle, with similar learning playthings according to the dynamically loaded playing abilities and optionally additional parameters, such as contact, proximity and/or self and/or relative movement.

The learning plaything includes a reader which reads a plurality of data marks indicative of a plurality of playing abilities and a memory for storing these playing abilities. The reader is optionally a barcode reader and/or an image reader for reading marks indicative of playing abilities from cards. The learning plaything further includes a communication unit which establishes wireless connection(s) with other learning playthings, such as peer to peer connections, during a game session. These wireless connection(s) allows a management unit to coordinate the outcome of the game session according to the playing abilities which are loaded to the memory and/or according to the playing abilities of other learning playthings. The learning plaything further includes a presentation unit which presents one or more plaything actions based on the outcome of the calculation. The presentation unit may be a display, a speaker, and/or actuating means for actuating the learning plaything or parts thereof.

According to some embodiments of the present invention, there is provided a method of managing an interactive game among a plurality of participants based on loaded playing abilities. The method is based on loading a plurality of different playing abilities into a plurality of different learning playthings by allowing each learning plaything to read one or more marks indicative of one or more of the playing abilities and establishing wireless connections between the learning playthings to transfer information about the loaded playing abilities from one of the learning playthings to others. This allows calculating, during a game session between the learning playthings, an outcome to the game session according to the playing abilities and instructing one or more of the learning playthings to present one or more plaything actions according to the outcome.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Reference is now made to FIG. 1, which is a schematic illustration of a learning plaything 100 that is set to be loaded with a number of playing abilities which may be transferred to another learning plaything according to outcomes of a game session, according to some embodiments of the present invention. The learning plaything 100 is optionally shaped or placed in a housing that is shaped as a figurine, a tossing element, a pawn, and or any other game element.

The learning plaything 100 includes a reader 101, such as a card reader, for example a barcode reader, and/or a wireless reader, such as a radio frequency identification (RFID) reader, which is capable of reading a plurality of data marks each indicative of another of a plurality of playing abilities. As used herein, a playing ability is a virtual ability of the learning plaything 100, which represents an action figure or the like, for example an ability to perform an action, a characteristic, a strength level, a weakness, a virtual magical ability, and the like. A playing ability also means a credit, such as a token, that allows the learning plaything 100 to participate in a certain game session, referred to herein also as playing credit. A game session may be an emulated fighting session between the learning plaything and other learning playthings 200, a contest between the learning plaything and the other learning playthings 200, and/or a calibration between the learning plaything and the other learning playthings 200.

For example, the reader 101 may be used to scan a unique combination of lines or colors from a collectable playing card. In such a manner, the learning plaything 100 can load one or more playing abilities into a memory 102. In another example, the reader 101 may be used to scan a playing ability indication that is presented on the screen of a computing device, such as a computer, television, a tablet, a Smartphone and the like. In another example, the reader 101 may be used to intercept a message that encodes a one or more playing abilities to be loaded, via a communication protocol such as an RFID communication, an SMS and the like. In another example, the reader 101 includes a wireless personal area network (WPAN) or a wireless local area network (WLAN) receiver for intercepting messages that encode one or more playing abilities to be loaded, an SMS and the like.

The learning plaything 100 further includes a communication unit 103 to establish a wireless connection with one or more respective communication units of one or more other learning playthings 200 during a game session. The communication unit 103 optionally includes a communication module, such as WPAN communication unit, for example a Bluetooth™ unit and/or an infrared unit, or a WLAN communication unit, such as a Wi-FI™ communication unit. Optionally, the wireless connection is a peer to peer connection. Alternatively, the wireless connection is established via a proxy, such as a wireless hotspot. Optionally, the communication unit 103 includes a speaker and a microphone or a transducer to facilitate acoustic and/or ultrasonic communication. In such an embodiment, the communication unit may embed messages in a music that is set to be played during a game session and/or extract messages which are embedded in such music.

Optionally, the communication unit 103 may be used for loading playing abilities and/or to adjust the playing abilities from a client terminal that is connected to a server, such as a web server. The server may manage a playing ability store wherein a player can purchase and/or select playing abilities, for example using the browser of the client terminal and/or a designated module that is installed thereon.

The learning plaything 100 further includes one or more presentation units 106, which are set to present one or more plaything actions. For example, the presentation units may include a set of one or more speaker(s), a screen, such as a liquid crystal display (LCD) screen, and/or the like. The presentation units 106 optionally include actuators for actuating the learning plaything 100. For example, if the housing of the learning plaything 100 is shaped as a humanoid action figure, the presentation units 106 include one or more motors for moving the limbs of the humanoid action figure. In another example, if the housing of the learning plaything 100 is shaped as a vehicle, the presentation units 106 includes one or more motors for moving the wheels of the vehicle.

The learning plaything 100 further includes a processor 104 and a management module 105 which uses the processor 104 to calculate, according to the stored playing abilities and optionally data that is received via the wireless connection, one or more plaything actions or reactions which are performed during a game session with one or more of the other learning playthings 200. These one or more plaything actions or reactions, referred to herein interchangeably, may be referred to as the outcome of the game session. The management module 105 may coordinate the actions or reactions which are performed during or after the game session by all the participating learning playthings 200. The coordination may be performed by locally calculating instructions per learning plaything and using the communication unit 103 for transferring the instructions and/or by calculating an outcome, transferring the outcome the learning playthings, and facilitating each one of the learning playthings to determine a reaction and/or action accordingly.

According to some embodiments of the present invention, learning playthings, each such as 100, manages a coordinated game session according to the playing abilities thereof. In such a manner, one player may load a first set of playing abilities to one learning plaything and another player may load a second set of playing abilities to a different learning plaything so that the outcome of a game session is decided, inter alia, according to a match between the first and second sets of playing abilities. The decision is optionally made by one of the management modules 105. The outcome is optionally a set of instructions that define one or more actions which are performed by the presentation unit(s) of the learning plaything 100 and/or the other learning playthings 200. For example, an outcome is a conversation between the learning playthings, a set of lights, displays or figures displayed on a screen or by a projector of the learning plaything 100, a set of sounds played by the learning playthings, optionally in a coordinated manner, and the like.

Optionally, a random generator is used to generate a random value that effects the calculation of the outcome of a game session. In such a manner, the outcome is not determined only by the loaded playing abilities.

Optionally, the order at which the playing abilities are loaded, for example read by the reader 101 effects the calculation of the outcome of a game session. For example, the order defines the weight each one of the loaded playing abilities receives and/or the timing of using the playing ability during the game session. For example, the reader 101 may be a scanner that is used to scan three indications from cards in a certain order that is selected by the player where the firstly scanned indication receive a high weight, the secondly scanned indication receive a medium weight, and the third scanned indication receive a low weight.

Optionally, the management module 105 updates the playing abilities of the learning plaything 100 according to the outcomes of game sessions. For example, if outcome of a game session is a winning of the learning plaything 100, the management module 105 increases its playing abilities to simulate an outcome of a good experience and if outcome of a game session is a loss of the learning plaything 100, the management module 105 reduces its playing abilities to simulate an outcome of a bad experience.

Optionally, the management module 105 validates the playing abilities of the learning plaything 100 according the time which has elapsed since the loading thereof. For example, loaded playing abilities may be valid for a period of few minutes, few hours, few days, and/or any other period that is defined in advance and/or set by the player or an operator. Additionally or alternatively, the management module 105 may validate the playing abilities of the learning plaything 100 according the number game sessions which has been conducted therewith. For example, if a first playing ability, for example "shooting fireballs" has been loaded, the management module 105 may count the number of game sessions wherein the "shooting fireballs" was exploited or could have been exploited.

Optionally, playing abilities are transferred from one learning plaything 100 to one or more of the other learning playthings 200 in response to the outcome of a game session. For example, if a certain learning plaything 100 loses a certain game session, one or more of the loaded playing abilities are transferred to one or more of the other learning playthings 200. If such an embodiment, the outcome of a gaming session may be automatically enforced. The transfer of playing abilities may be accompanied with an actual transfer of one or more physical elements, such as cards, which include mark(s) indicative of the transferred playing abilities.

Optionally, the learning plaything 100 includes a timer 151 which monitors the reading time of the plurality of playing abilities. In such a manner, the playing abilities may be associated with an expiration date or changed over a period of time.

Optionally, the learning plaything 100 includes one or more sensors that allow the management module 105 to calculate the outcome of a game session based on physical changes in the surrounding of the learning plaything 100. For example, the learning plaything 100 includes a movement sensor for detecting a movement of the learning plaything 100 or of objects in relation to the learning plaything 100. The management module 105 may calculate the outcome of the gaming session according to the sensed movement. For example, when the learning plaything 100 is a tossing element which is set to tossed by a player, the management module 105 may take into account information pertaining to the detected movement, for example velocity. Optionally, the movement sensor 152 includes an accelerometer. The accelerometer may be used to measure a rotation rate. The learning plaything 100 may be a rotating element, such as a spinning top and the management module 105 may take into account information pertaining to the detected rotation rate.

Optionally, the learning plaything 100 includes a proximity sensor for detecting proximity of the learning plaything 100 to other objects, for example to the one or more other learning playthings 200. The management module 105 may calculate the outcome of the gaming session according to the sensed proximity. For example, when the learning plaything 100 is a tossing element that is set to be tossed by a player, the management module 105 may take into account the proximity of the learning plaything 100 to other objects after the tossing thereof by the player. For example, if the distance is below a certain distance, the chances of the learning plaything 100 to win a game session are increased and if the distance is above the certain distance, the chances of the learning plaything 100 to win a game session are reduced. In such an embodiment, a player that tosses his learning plaything 100 to certain proximity to a reference object, such as another learning plaything, receives a different score from another player that tosses another similar learning plaything to a different proximity to the reference object (or another reference object).

Optionally, the learning plaything 100 includes a contact sensor for detecting a contact between the learning plaything 100 and other objects, for example the one or more other learning playthings 200. The management module 105 may calculate the outcome of the gaming session according to the sensed contact. For example, when the learning plaything 100 is a tossing element, for example as described above, the management module 105 may take into account the contact. For example, if contact is sensed, the chances of the learning plaything 100 to win a game session are increased and if no contact is sensed, the chances of the learning plaything 100 to win a game session are reduced or vice versa.

Figure 2A:
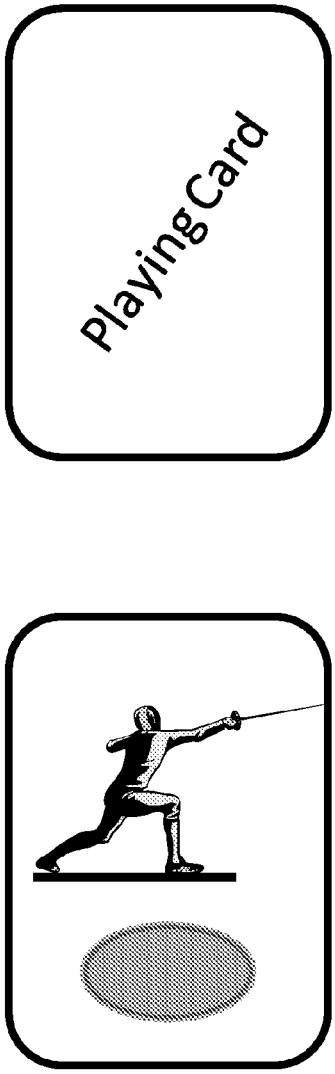
FIGS. 2A and 2B are schematic illustrations of exemplary card and chip which are designed to be read by the card/chip reader of the learning plaything, according to some embodiments of the present invention.
Figure 2B:
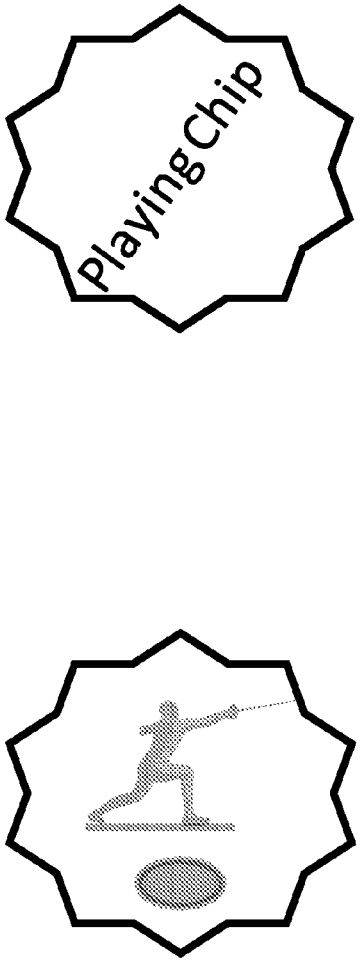

As described above, the reader 101 may be a card reader or a chip reader. Optionally, the card reader includes a card slot for hosting one or more cards marked with mark(s) which are indicative of playing abilities, for example as shown in FIG. 2A. Additionally or alternatively, the card reader includes a chip slot for hosting one or more chips marked with mark(s) which are indicative of playing abilities, for example as shown in FIG. 2B. The card reader optionally includes an ejection mechanism that is set to eject cards according to outcomes of a game session as calculated by the management module 105. In such an embodiment, cards may be automatically ejected when the learning plaything 100 losses in a game session. The ejection mechanism may launch the card toward the one or more learning playthings 200.

Figure 3A:
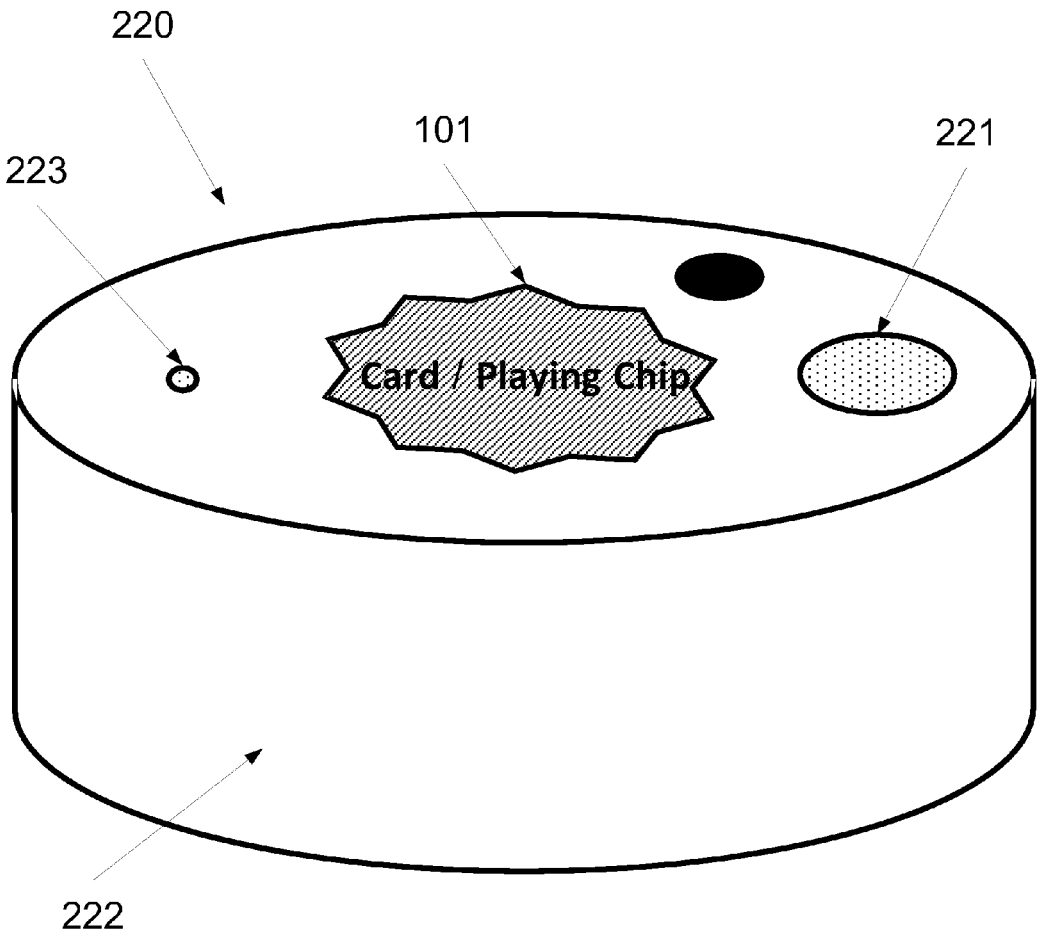
FIGS. 3A-3D are schematic illustrations an exemplary learning plaything, exemplary learning plaything during a game session, exemplary learning playthings which are designed to eject loaded card and/or a chip during a game session, and exemplary learning plaything which is loaded with a number of playing abilities, according to some embodiments of the present invention.
Figure 3B:
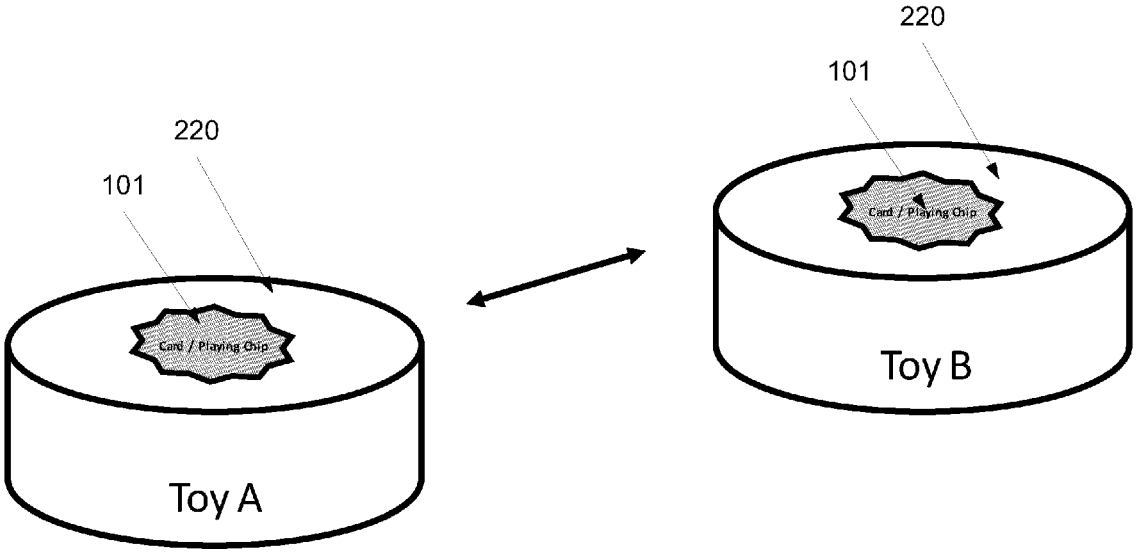
Figure 3C:
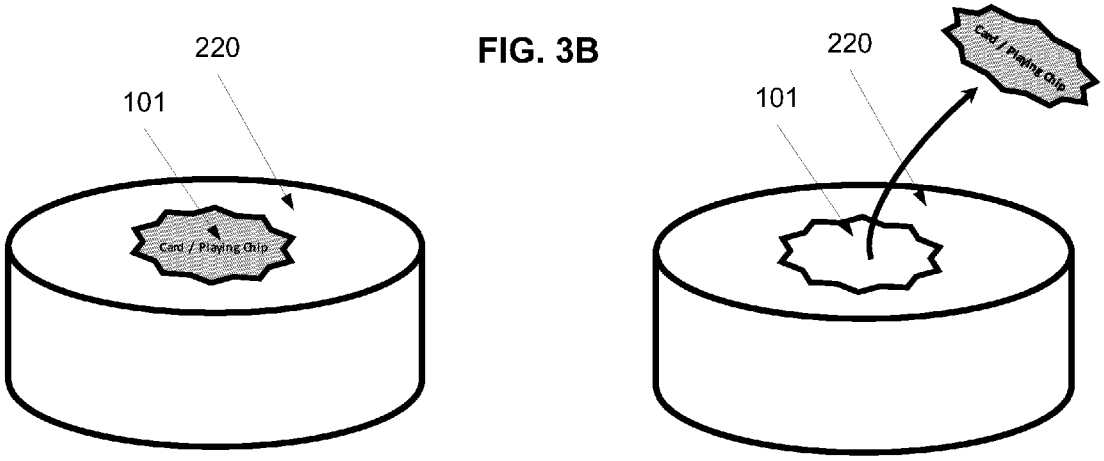
Figure 3D:
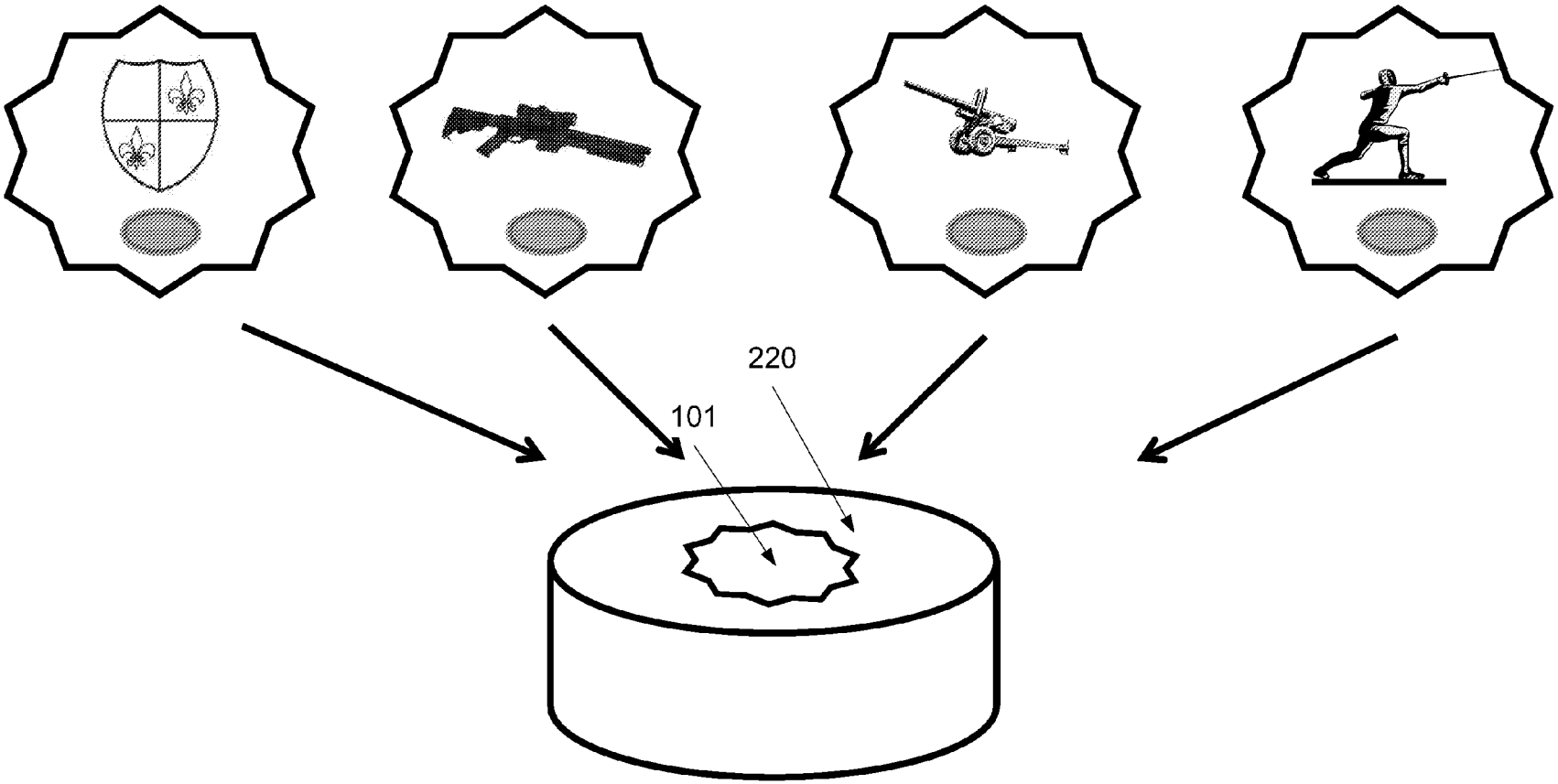

For example reference is now made to FIGS. 3A-3D. FIG. 3A is a schematic illustration of an exemplary learning plaything 220 having the reader 101, presentation units 106 which includes a speaker 221 and a communication unit 103 which includes a microphone 223, according to some embodiments of the present invention. The reader is designed to hold a card and/or a chip, optionally in a designated shape. The housing 222 of the exemplary learning plaything 220 is shaped as a disc. As depicted in FIG. 3B such exemplary learning playthings 220 are designed to communicate with one another, simulating a game session and coordinate the outcome thereof based on at least the cards which are placed in the card reader 101. As depicted in FIG. 3C, the card reader includes an ejection mechanism that ejects the loaded chips and/or cards according to outcomes of the game session. As described above and depicted in FIG. 3D, various chips may be placed in the card reader 101, optionally in a certain order, to load playing abilities to the exemplary learning plaything 220.

According to some embodiments of the present invention, the reader 101, or elements thereof, is integrated into a launcher for launchable elements, such as plaything rockets or plaything bullets. The launcher is optionally part of the learning plaything 100. In these embodiments, launchable elements have indications of a playing ability pertaining to the element itself. In use, the user places the launchable elements in the launcher so as to allow the reader 101 to read the indication which is printed or otherwise associated therewith. Based on the reading, the management module 105 instructs the operation of the launcher. In such a manner the launcher may change its functioning based on the read indications. For example, different elements may be tossed to different distances and/or with a different power according to the respective indication.

Figure 4:
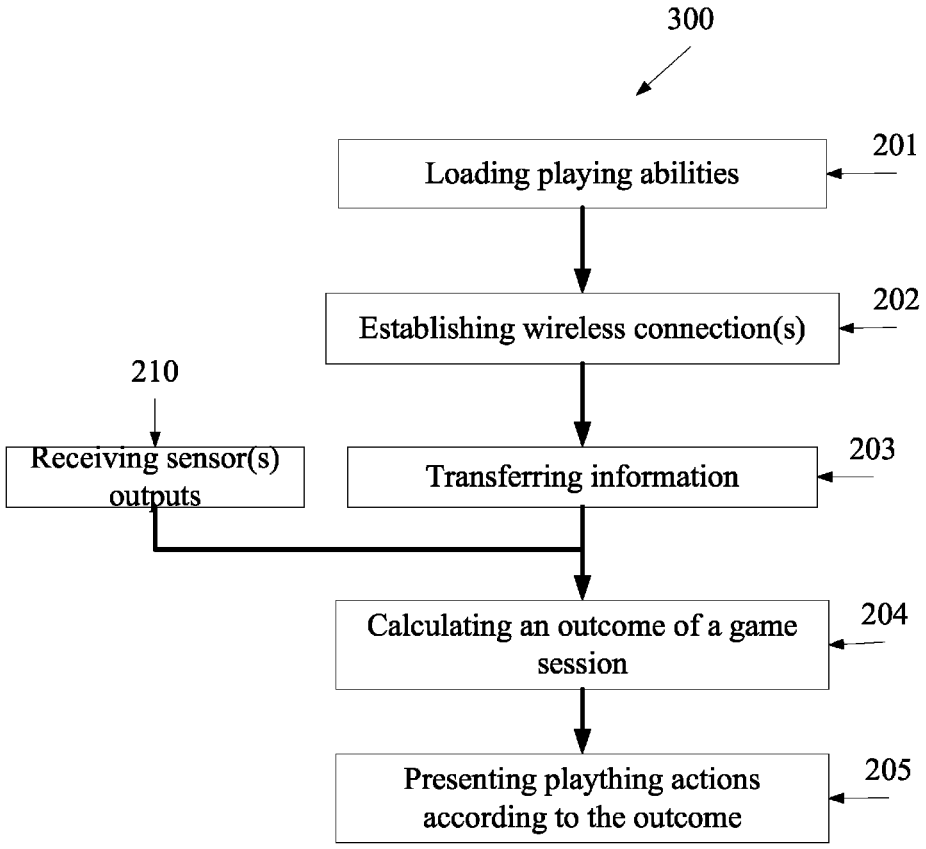
FIG. 4 is a flowchart of a method of managing an interactive game among a plurality of participants using a plurality of learning playthings, each, for example, is as learning plaything depicted in FIG. 1, according to some embodiments of the present invention.

Reference is now made to FIG. 4, which is a flowchart of a method 300 of managing an interactive game among a plurality of participants using a plurality of learning playthings, each, for example, is as learning plaything 100 depicted in FIG. 1, according to some embodiments of the present invention.

First, as shown at 201, one or more different playing abilities are loaded into each of a plurality of different learning playthings. The loading is performed by allowing each learning plaything to read one or more indications, such as marks indicative of one or more playing abilities. For example, each player may place his learning plaything in front of one or more collectable cards so that the reader of the respective learning plaything can read barcode(s) which are printed on the respective collectable cards.

Now, the plurality of learning playthings coordinate an outcome to the game session based on the loaded playing abilities and optionally on the outputs of sensors which monitor the movement of the learning playthings and/or their proximity to one another and/or to reference objects. For example, as shown at 202, one or more wireless connections, optionally direct, are established between the learning playthings. For example, when the players place the learning playthings in proximity to one another a WPAN peer to peer connection(s) is established therebetween.

Optionally, as shown at 210, the inputs from sensors, such as the aforementioned proximity, movement, and/or contact sensors are received.

As shown at 203, the wireless connections are then used to transfer information about the loaded playing abilities from at least one of the learning playthings to the others. This allows, as shown at 204, calculating, during a game session among (or between) the plurality of learning playthings, an outcome for the game session according to the combination of loaded playing abilities. Optionally, the calculation calculates the outcome based on a random variable so that that the outcome is not predictable based on the loaded playing abilities only. The outcome may be calculated may be performed by one of the learning playthings and transferred to the others using the wireless connection. Alternatively, the outcome may be calculated by all the learning playthings simultaneously. Optionally, the outcome may be calculated according to the outputs of the sensors, for example the outputs received at 210.

Figure 5:
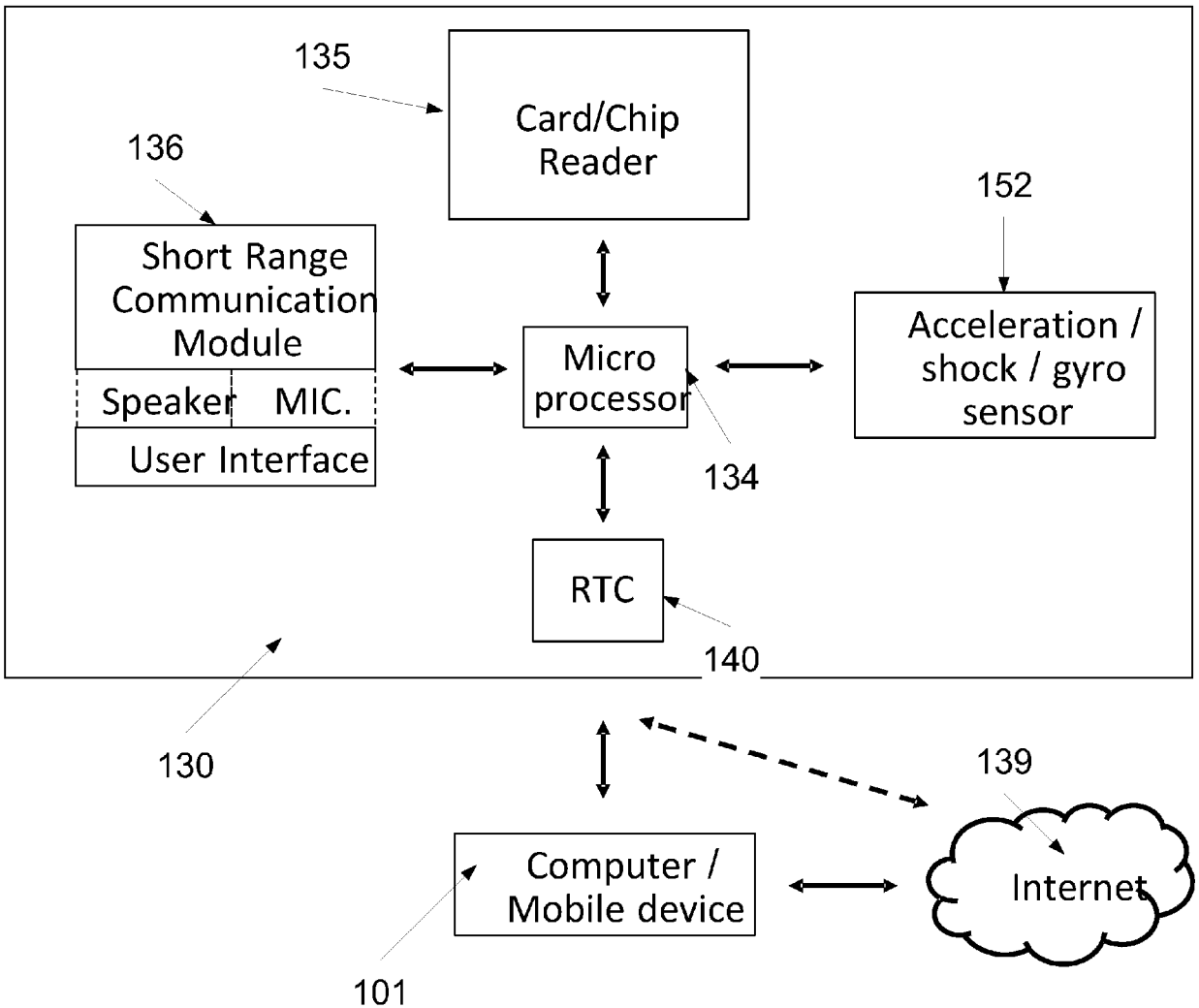
FIG. 5 is a schematic illustration of modules of an exemplary learning plaything which communicates with a client terminal and/or another learning plaything, optionally via a computer network, such as the internet, according to some embodiments of the present invention.

For example reference is also made to FIG. 5, which is a schematic illustration of modules of an exemplary learning plaything 130 which communicates with a client terminal 131 and/or another learning plaything 100, optionally via a computer network 139, such as the internet, according to some embodiments of the present invention.

The learning plaything 130 includes a micro processor 134, that functions as the processor 104, a card reader 135, optionally with an ejection mechanism, for example as described above with reference to 101, a short range communication unit 136, for example as described above with reference to 103, which includes a user interface, a speaker and a microphone, and the aforementioned sensors 152. Optionally, the learning plaything 130 includes a real time clock (RTC) 140 for coordinating the presentation of actions during the game session. In such an embodiment learning playthings may establish communication sessions over the network 139. Optionally, a network node (not shown) which is connected to the network calculates, during a game session among (or between) the learning playthings, an outcome for the game session according to the combination of loaded playing abilities. The network node forwards the outcome to the learning playthings via the network.

Now, as shown at 205, one or more of the playthings perform one or more actions according to the outcome. For example, if the outcome is a winning of one plaything over the other, the winning plaything is instructed to present a winning gesture, for example raising handles or moving in circles, and the losing plaything is instructed to present a losing movement, for example to falling or moving backwards.

It is expected that during the life of a patent maturing from this application many relevant systems and methods will be developed and the scope of the term a presentation unit, a processor, a memory, and a sensor is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A learning plaything which is configured to communicate with similar learning playthings during a game session, comprising:

a reader which reads a plurality of data marks indicative of a plurality of playing abilities, and including a card slot for hosting at least one of a plurality of cards marked with said plurality of data marks, and an ejection mechanism for ejecting said at least one card of said plurality of cards;

a memory for storing said plurality of playing abilities;

a communication unit which establishes at least one wireless connection with another communication unit of at least one other learning plaything during a game session;

a management module which uses said at least one wireless connection to coordinate an outcome to said game session with said at least one other learning plaything according to said stored plurality of playing abilities; and at least one presentation unit which presents at least one plaything action according to said outcome, said at least one plaything action comprising instructing said ejection mechanism to eject said at least one card.

2. The learning plaything of claim 1, further comprising a timer which monitors the reading time of said plurality of playing abilities; wherein said management module adjusts said plurality of playing abilities according to said reading time.

3. The learning plaything of claim 1, wherein said management module updates said plurality of playing abilities according to said at least one action.

4. The learning plaything of claim 1, wherein said communication unit embeds a message to said another communication unit in a theme music played during said game session.

5. The learning plaything of claim 1, wherein said at least one action is indicative of a group of at least one of said plurality of playing abilities to transfer to said at least one other learning plaything, said communication unit sends a message indicative of said group to said at least one other learning plaything.

6. The learning plaything of claim 1, further comprising a movement sensor for detecting a movement of said learning plaything or at least one object in relation thereto; wherein said management module calculates said at least one action according to said movement.

7. The learning plaything of claim 1, further comprising a proximity sensor for detecting a proximity of said at least one other learning plaything; wherein said management module calculates said at least one action according to said proximity.

8. The learning plaything of claim 1, further comprising a contact sensor for detecting a contact between said at least one other learning plaything and said learning plaything; wherein said management module calculates said at least one action according to said contact.

9. The learning plaything of claim 1, wherein said ejection mechanism performs said ejecting with a power defined by said at least one card.

10. The learning plaything of claim 1, wherein said at least one presentation unit comprises a screen for displaying said plurality of stored playing abilities.

11. The learning plaything of claim 1, wherein said management module calculates said at least one plaything action according to a random value generated by a random generator.

12. The learning plaything of claim 1, wherein said management module calculates said at least one plaything action according to a match between said plurality of playing abilities and a plurality of other playing abilities of said at least one other learning plaything.

13. An interactive system for providing entertainment to a plurality of participants, the interactive system comprising:

a plurality of learning playthings which are set to communicate with one another during a game session, each said learning plaything having:

a reader which reads a plurality of data marks indicative of a plurality of playing abilities, and including a card slot for hosting at least one of a plurality of cards, each of said cards marked with said plurality of data marks, and an ejection mechanism for ejecting said at least one card of said plurality of cards;

a memory for storing said plurality of playing abilities;

a communication unit which establishes a wireless connection with another communication unit of at least one other learning plaything during a game session;

a management module which uses said wireless connection to coordinate at least one plaything action with said at least one other learning plaything according to said stored plurality of playing abilities; and at least one presentation unit which presents said at least one plaything action comprising instructing said ejection mechanism to eject said at least one card.

14. A method of managing an interactive game among a plurality of participants, comprising:

loading a plurality of different playing abilities into a plurality of different learning playthings by allowing a card reader of each said different learning plaything to read at least one data mark from at least one card loaded by a user into said card reader of each said different learning plaything, said at least one data mark indicative of at least one of said plurality of different playing abilities;

establishing at least one wireless connection between said plurality of learning playthings to transfer information about said plurality of loaded different playing abilities from at least one of said plurality of learning playthings to another;

calculating, during a game session between said plurality of learning playthings, an outcome to said game session according to said plurality of different playing abilities; and instructing at least one of said plurality of different learning playthings to present at least one plaything action according to said outcome, said at least one at least one card.

15. The method of claim 14, wherein said at least one wireless connection is a peer to peer connection.

16. The method of claim 14, wherein said at least one wireless connection is established via a proxy.

17. The method of claim 14, wherein said loading is performed in a certain order, said calculating being performed according to said certain order.

18. The method of claim 14, wherein said calculating is based on a random variable.

19. The method of claim 14, further comprising detecting a proximity to a reference object; and said calculating is based on said proximity.

20. The method of claim 14, further comprising detecting a movement of at least one of said different learning playthings during said game session; and said calculating is based on said movement.

21. The method of claim 14, further comprising detecting a presence or absence of a contact to an object; and said calculating is based on said detecting.

* * * * *